US008209897B2

(12) United States Patent
Schneider et al.

(10) Patent No.: US 8,209,897 B2
(45) **Date of Patent: *Jul. 3, 2012**

(54) TARGETING SYSTEM FOR A PROJECTILE LAUNCHER

(75) Inventors: John F. Schneider, Huntingburg, IN (US); Christopher Brown, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/157,814

(22) Filed: Jun. 10, 2011

(65) Prior Publication Data

US 2012/0138681 A1 Jun. 7, 2012

Related U.S. Application Data

(63) Continuation of application No. 12/125,600, filed on May 22, 2008, now Pat. No. 7,966,763.

(51) Int. Cl.
*F41C 27/06* (2006.01)

(52) U.S. Cl. ..... 42/105

(58) Field of Classification Search ..... 42/105, 42/75.02, 75.01, 77, 75.04; 89/1.41, 126, 89/13.1, 41.16, 41.02, 41.17
See application file for complete search history.

(56) References Cited

U.S. PATENT DOCUMENTS

| | | | | |
|---|---|---|---|---|
| 12,522 | A | 3/1855 | Wolter | |
| 1,031,279 | A | 7/1912 | Maxim | |
| 1,270,293 | A | 6/1918 | Hoexter et al. | |
| 1,311,860 | A | 7/1919 | Holzwarth | |
| 2,876,679 | A | 3/1959 | Dietsch et al. | |
| 2,949,825 | A | 8/1960 | Walton et al. | |
| 3,550,300 | A | 12/1970 | Röder | |
| 3,641,691 | A | 2/1972 | Ellis et al. | |
| 3,824,699 | A | 7/1974 | Lenz et al. | |
| 3,955,299 | A | 5/1976 | Bullis | |
| 4,195,432 | A | 4/1980 | Hickman | |
| 4,326,340 | A | 4/1982 | Blomqvist et al. | |
| 4,574,685 | A | 3/1986 | Sanborn et al. | |
| 4,635,526 | A | 1/1987 | Mottana et al. | |
| 4,689,911 | A | 9/1987 | White | |
| 4,695,161 | A | 9/1987 | Reed | |
| 5,171,933 | A | 12/1992 | Eldering | |
| 5,555,662 | A | 9/1996 | Teetzel | |
| 5,669,174 | A | 9/1997 | Teetzel | |
| 5,831,718 | A | 11/1998 | Desai et al. | |
| 6,014,923 | A | 1/2000 | Canaday et al. | |
| 6,269,726 | B1 | 8/2001 | McNulty, Sr. | |
| 6,568,118 | B1 | 5/2003 | Teetzel | |
| 6,708,597 | B2 | 3/2004 | Meyers et al. | |
| 6,886,287 | B1 | 5/2005 | Bell et al. | |
| 6,973,865 | B1 | 12/2005 | Duselis et al. | |
| 7,021,188 | B1 | 4/2006 | Berkovich et al. | |
| 7,089,845 | B2 | 8/2006 | Friedli et al. | |
| 7,143,539 | B2 | 12/2006 | Cerovic et al. | |
| 7,171,776 | B2 | 2/2007 | Staley, III | |
| 7,210,392 | B2 | 5/2007 | Greene et al. | |
| 2003/0177897 | A1 | 9/2003 | Bar | |
| 2004/0050240 | A1 | 3/2004 | Greene et al. | |
| 2004/0134340 | A1 * | 7/2004 | Quinn | 89/41.01 |
| 2005/0132874 | A1 | 6/2005 | Cianciolo | |
| 2006/0162226 | A1 | 7/2006 | Tai | |
| 2007/0119296 | A1 * | 5/2007 | Niv et al. | 89/37.02 |
| 2008/0148931 | A1 | 6/2008 | Svensson et al. | |

* cited by examiner

*Primary Examiner* — Bret Hayes
*Assistant Examiner* — Reginald Tillman, Jr.
(74) *Attorney, Agent, or Firm* — Christopher A. Morsey

(57) ABSTRACT

A targeting system for determining the distance to a target and, in response thereto, altering the angular position of a projectile launcher relative to a hand held support.

7 Claims, 5 Drawing Sheets

TARGETING SYSTEM FOR A PROJECTILE LAUNCHER

CROSS-REFERENCE TO RELATED APPLICATION

This application is a continuation of U.S. patent application Ser. No. 12/125,600, filed May 22, 2008, to be issued as U.S. Pat. No. 7,966,763 on Jun. 28, 2011, the disclosures of which are expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon.

BACKGROUND OF THE INVENTION

The present invention relates generally to devices for aiming weapons and, more particularly, to a targeting system for a projectile launcher supported by a hand held support structure.

It is known to couple a projectile launcher to a rifle, thereby giving the user an integrated weapon that may selectively deliver two different types of projectiles. More particularly, the rifle discharges a projectile with a low arc trajectory (such as a bullet), while the projectile launcher discharges a projectile with a high arc trajectory (such as a grenade). Typically, a first targeting sight is provided for the rifle, and a separate second targeting sight is provided for the projectile launcher. As such, the user must switch between different sights for tracking a target when alternating between use of the rifle and the projectile launcher. Switching between sights in order to engage a target can often be a time consuming exercise. Further, targeting for the projectile launcher has conventionally been accomplished through the use of a leaf sight often requiring significant experience for efficient use thereof. As such, there has been an increased emphasis on improving the targeting systems on rifle mounted projectile launchers.

SUMMARY OF THE INVENTION

According to an illustrative embodiment of the present disclosure, a projectile launching apparatus includes a barrel configured to discharge a first projectile, and a projectile launcher supported by the barrel and configured to discharge a second projectile. An actuator is operably coupled to the barrel and the projectile launcher. The actuator is configured to adjust an angle of inclination of the projectile launcher relative to the barrel.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

Figure 1:
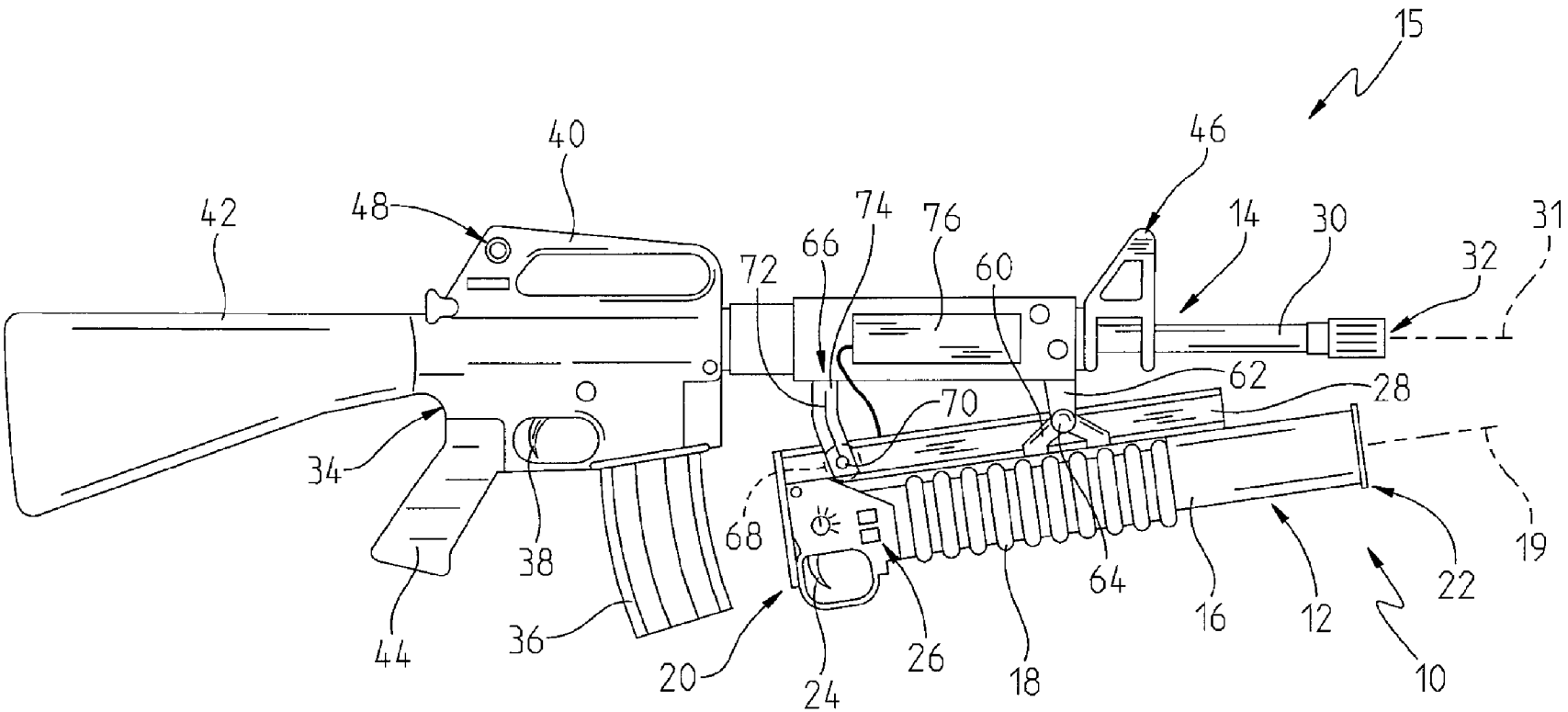
FIG. 1 is a side elevational view of the targeting system of the present disclosure operably coupling a projectile launcher to a barrel of a rifle.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Referring initially to FIG. 1, a targeting system 10 according to the present disclosure is shown operably coupling a projectile launcher 12 to a hand held support structure, illustratively a rifle 14. The projectile launcher 12 and the rifle 14 together define a dual projectile weapons platform 15. In the illustrative embodiment, the projectile launcher 12 comprises an M203 grenade launcher, while the rifle 14 comprises an M16 (AR15) assault rifle. However, it should be appreciated that any suitable projectile launcher 12 may be utilized in connection with the targeting system 10 of the present disclosure. Furthermore, the targeting system 10 of the present disclosure may be utilized with any hand held support structure, including a wide variety of small arms, such as rifle 14.

Figure 2:
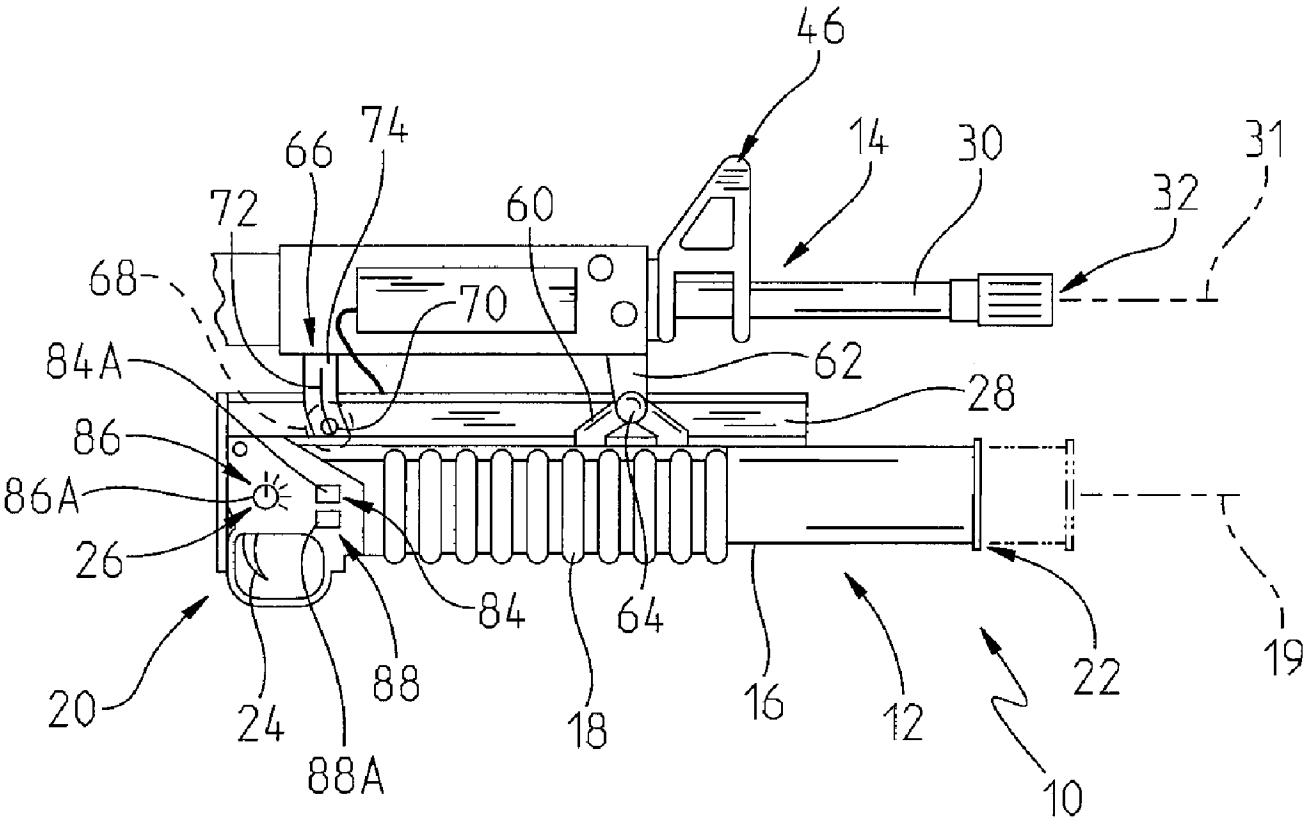
FIG. 2 is a detailed side view of FIG. 1, showing an optional active position of the projectile launcher in phantom.

With reference now to FIGS. 1 and 2, the projectile launcher 12 illustratively includes a launch tube or barrel 16 supporting a barrel grip 18. The launch tube 16 extends along a longitudinal axis 19 between a receiving end 20 and a discharge end 22. A trigger 24 is operably coupled to the tube 16 in order to mechanically interface with the projectile 25 positioned within the receiving end 20 of the tube 16 and cause activation of a propellant to launch or discharge the projectile from the discharge end 22. A user interface 26 is supported by the tube 16 and is positioned proximate the receiving end 20 above the trigger 24. A housing 28 is illustratively coupled to and supported above the tube 16.

With further reference to FIG. 1, the rifle 14 includes a barrel 30 having a longitudinal axis 31 and a discharge end 32. A receiver 34 is coupled to the barrel 30 and is configured to receive projectiles 35 (i.e., bullets) from a magazine 36. The receiver 34 includes a trigger 38 which is configured to mechanically impact bullets 35 and cause the discharge thereof from the discharge end 32 of the barrel 30. A handle 40 and a buttstock 42 are coupled to the receiver 34. A pistol grip 44 is also coupled to the receiver 34 and extends downwardly therefrom in spaced relation to the magazine 36. A front sight 46 is coupled to the barrel 30, while a rear sight 48 is supported by the receiver 34. The front sight 46 and the rear sight 48 are utilized together by a user to aim or engage a target.

Figure 3:
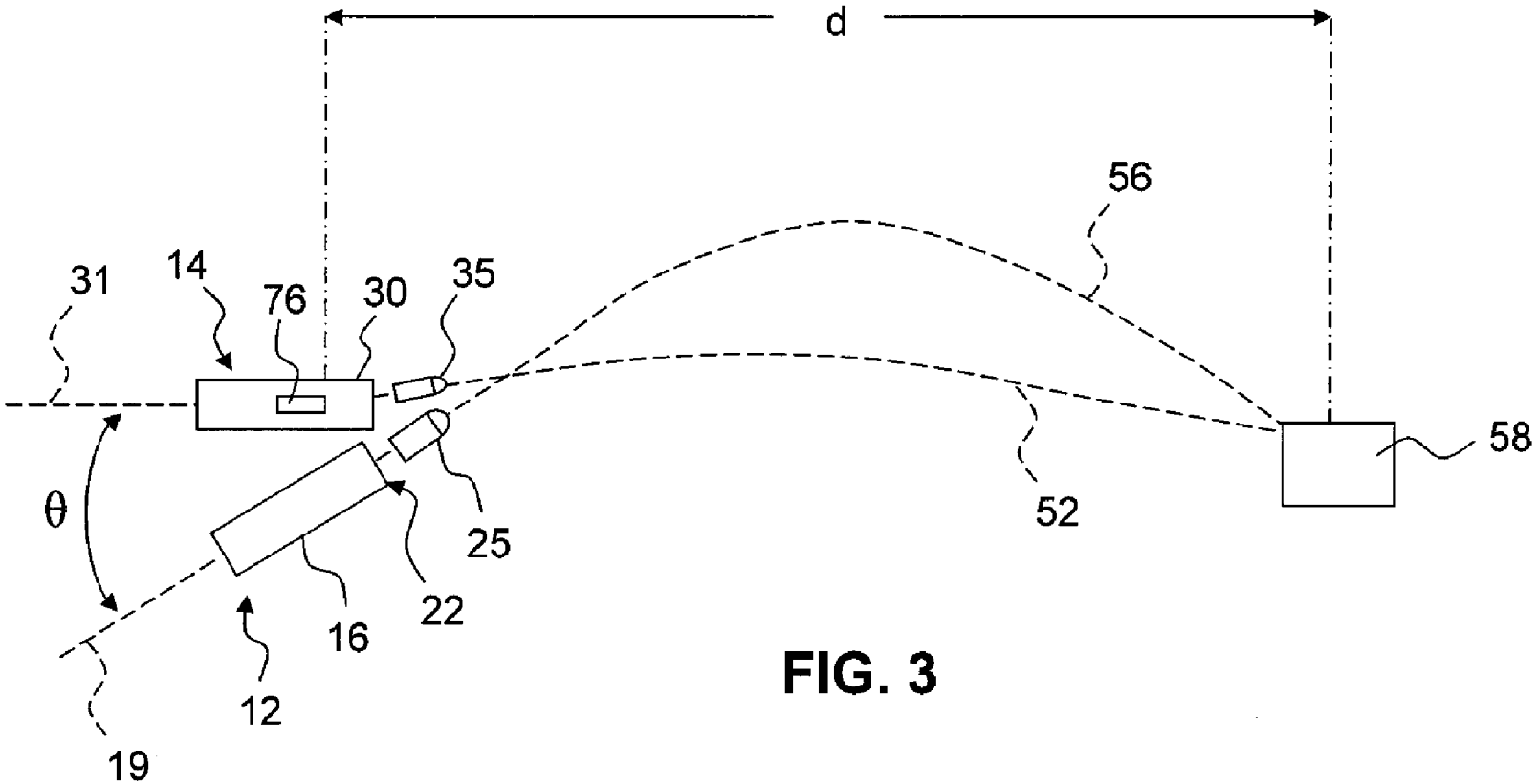
FIG. 3 is a diagrammatic view showing an illustrative low arc trajectory from a projectile discharged from the barrel of the rifle of FIG. 1, and a illustrative high arc trajectory of a projectile discharged from the projectile launcher of FIG. 1.
Figure 4:
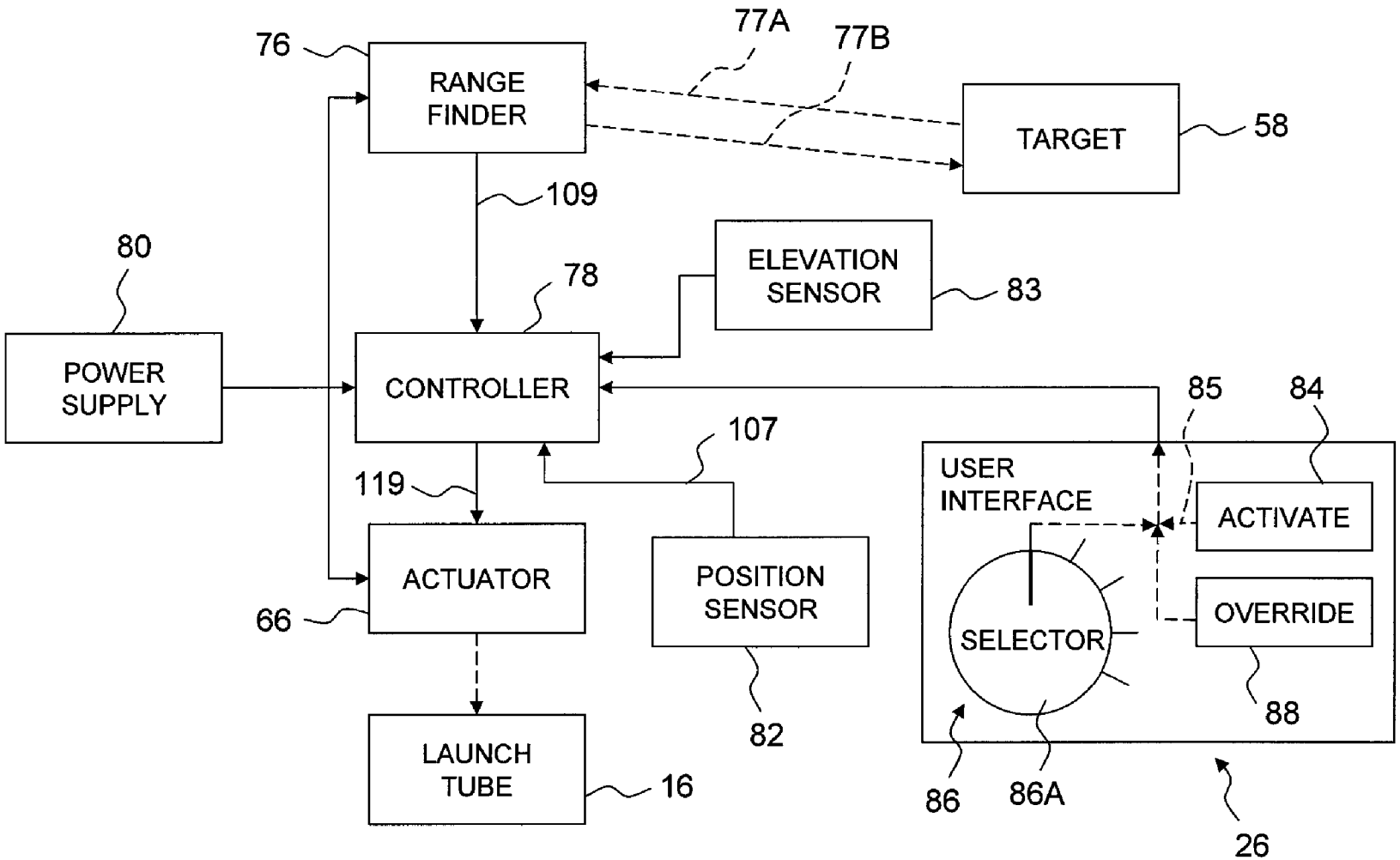
FIG. 4 is a block diagram showing interaction between various illustrative components of the targeting system of FIG. 1.

As mentioned above, the rifle 14 is configured to discharge projectile 35, such as a bullet, having a low arc trajectory 52 as diagrammatically illustrated in FIG. 3. The projectile launcher 12 is configured to discharge projectile 25, such as a grenade, having a high arc trajectory 56. As may be appreciated, the angle of inclination θ between the axis 19 of the projectile launcher 12 and the axis 31 of the rifle 14 must be properly established in order for the projectile 25 to reach the intended target 58.

With reference now to FIGS. 1-4, the projectile launcher 12 is operably coupled to the rifle 14 for angular movement therebetween and thereby setting the angle of inclination θ to a desired value. More particularly, the projectile launcher 12 includes an upwardly extending bracket 60 coupled to a lower bracket 62 through a pivot pin 64. An actuator 66 is configured to pivotally move the receiving end 20 of the projectile launcher 12 upwardly and downwardly about the pivot pin 64. In one illustrative embodiment, the actuator 66 includes a stepper motor 68 operably coupled to a drive wheel or roller 70 configured to move within a track 72 formed within a support bracket 74. The stepper motor 68 may be operably coupled to the roller 70 through a conventional worm gear mechanism (not shown).

A range input device, illustratively a range finder 76, is coupled to the rifle barrel 30 and is configured to determine a distance d to the target 58. More particularly, the range finder 76 may be a conventional laser range finder configured to emit and receive a laser beam 77 aimed at a target. Such laser range finders are known in the art and typically operate by measuring the time difference between the finder 76 from sending a laser beam pulse 77A to target 58, to receiving a laser beam pulse 77B reflected off of the target 58. While a laser range finder 76 is shown in the illustrative embodiment, other range finders may be used to determine the distance d to the target 58. In alternative embodiments, the range input device may be configured to permit manual input of the distance d to the target 58, thereby eliminating the laser range finder 76.

The range finder 76 is operably coupled to a controller 78. The controller 78 may comprise a conventional EPROM based control circuit, although software operated controllers could be substituted therefore. A power supply 80, illustratively a battery, is operably coupled to the range finder 76, the controller 78, and the actuator 66. Both the controller 78 and the power supply 80 are illustratively received within the housing 28 of the projectile launcher 12. A position sensor 82 is also operably coupled to the controller 78 and is configured to provide an indication of the angle of inclination θ of the longitudinal axis 19 of the projectile launcher 12 to the longitudinal axis 31 of the rifle 14. In one illustrative embodiment, the position sensor 82 is incorporated within the actuator 66 (e.g. a stepper motor providing feedback by counting the number of increments or "steps" that it takes) such that a separate device is not necessary. An elevation sensor 83 may also be operably coupled to the controller 78 and is configured to provide an indication of the angle of elevation of the longitudinal axis 31 of the riffle barrel 30 to horizontal (i.e. level or cant of the riffle 14), thereby providing a reference point for the controller 78.

In further illustrative embodiments, the controller 78 may receive GPS or reference coordinates of the launcher 12 which are compared to firing or target coordinates of the target 58 provided by the user, another person/spotter, an unmanned aerial vehicle (UAV) or other platform. In other words, the target coordinates define the range signal for the controller 78 to determine the required amount and direction of angular movement of the launch tube 16. Illustratively, the reference and target coordinates may be provided by an automatic information system, such as the Global Command and Control System (GCCS).

The user interface 26 illustratively includes an activate input 84, such as a push button 84A, configured to enable the controller 78 to activate the actuator 66. When the controller 78 is in an inactive or disabled mode, the actuator 66 will not adjust the projectile launcher tube 16 relative to the rifle 14. As such, the actuator 66 will not unnecessarily adjust the launcher 12 when targeting is not desired. By depressing input 84, an activate signal 85 is sent to the controller 78 to enable operation of the actuator 66. In a further illustrative embodiment, the activate input may include a sensor (not shown) operably coupled to the controller 78 and configured to detect forward movement of the launch tube 16. More particularly, when the projectile launch tube 16 is slid forward relative to the barrel 30 (shown in phantom in FIG. 2), the controller 78 is enabled to activate the actuator 66.

The user interface 26 further includes a selector 86, such as a rotary switch 86A, which may be manipulated by the user to select between different types of projectiles 25. For example, various projectiles 25 having different trajectories 56 (due to, for example, propellants providing different initial projectile velocities, and different projectile aerodynamics) may be utilized within the launcher 12. Such projectiles may include high explosive grenades, non-lethal rounds (e.g., bean bags and rubber bullets), illuminating grenades, smoke grenades, CS gas (i.e., tear gas) grenades, and high explosive dual purpose grenades. By selecting different types of projectiles, the controller 78 provides for the proper adjustment of the launch tube based upon the anticipated trajectory.

The controller 78 may also be configured to deactivate or disable the trigger 24 of the launcher 12 should the distance d detected by the range finder 76 exceed the maximum range of the projectile 25 as determined by the controller 78. As such, the controller 78 prevents the user from discharging rounds or projectiles which are not likely to hit the target 58. An override input 88, such as a push button 88A, may be manipulated by the user in order to enable the trigger 24 to fire the projectile 25 from the launch tube 16 even if the distance detected d exceeds the maximum range of the projectile 25.

Figure 5:
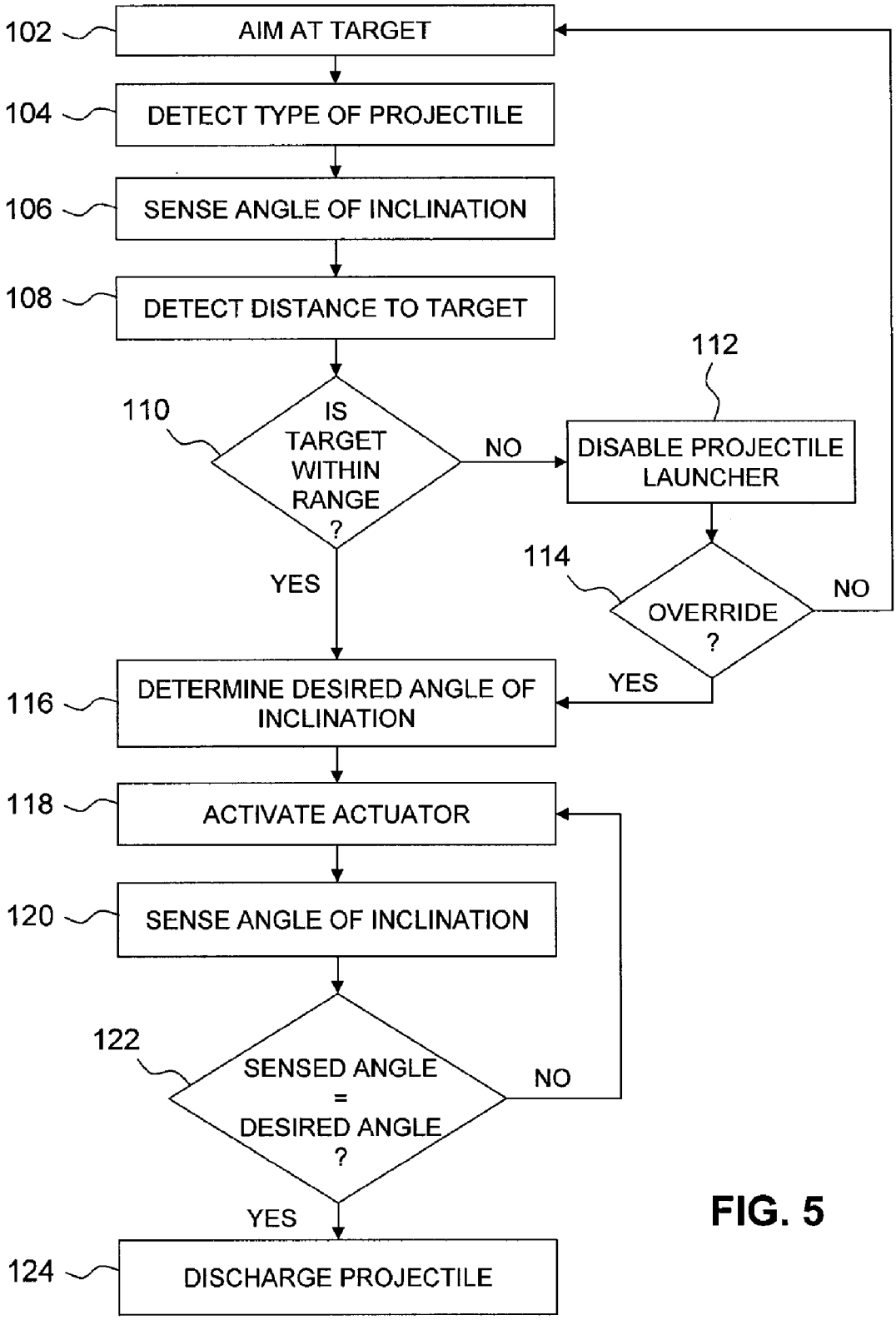
FIG. 5 is a flow chart of an illustrative method of operating the targeting system of FIG. 1.

Referring now to FIG. 5, an illustrative method of operation of the targeting system 10 of the present disclosure is shown. At block 102, the user aims at the desired target 58. At block 104, the controller 78 detects the type of projectile 25 based upon the input from the selector 86 as manipulated by the user. More particularly, the user illustratively engages target 58 by using the sights 46 and 48 supported by the rifle 14. Next, at block 106, the controller 78 receives a position signal 107 from the position sensor 82 representative of the angle of inclination θ of the launch tube 16 relative to the barrel 30. The range finder 76 detects distance d to the target 58 and provides a range signal 109 indicative thereof to the controller 78 at block 108. By knowing the type of projectile 25 in the launch tube 16, and the angle of inclination θ, the controller 78 can determine a projected trajectory 56 based upon the anticipated velocity of the projectile 25 at the discharge end 22 of the launch tube 16.

At block 110, the controller 78 queries whether the target 58 is within the maximum range of the projectile 25. If the distance d exceeds the maximum range of the projectile 25, then the projectile launcher trigger 24 is disabled at block 112. A block 114, the controller 78 queries for activation of the override 88. If the override 88 is not activated, then the launcher 12 remains disabled. If the override 88 is activated, then the desired angle of inclination θ is calculated by the controller 78.

The controller 78 illustratively determines the desired angle of inclination θ based upon the formula $$d = \frac{v^2}{g}\sin\theta,$$

where g is the gravitational acceleration (usually taken to be 9.81 m/s$^2$ near the Earth's surface); θ is the angle at which the projectile 25 is launched; v is the velocity at which the projectile 25 is launched; and d is the total horizontal distance traveled by the projectile 25. As such, the angle of inclination θ is dependent upon discharge velocity (characteristic of the projectile 25 as input by the selector 86) and distance d to the target 58.

As is known, the trajectory of projectile 25, and therefore the angle of inclination θ required to reach the target 58, may vary based upon other conditions (such as elevation differences between the discharge end 22 of the launch tube 16 and the target 58, and environmental factors including wind speed/direction, temperature and humidity). Input devices, such as sensors, may be provided to supply signals indicative of these conditions to the controller 78. In further illustrative embodiments, such condition signals may be manually input by the user through the user interface 26. In one illustrative embodiment, the elevation sensor 83 detects the level or cant of the riffle 14 and provides a signal indicative thereof to the controller 78, thereby accounting for elevation differences between the discharge end 22 of the launch tube 16 and the target 58 when determining the adjustment required of the launch tube 16 relative to the barrel 30.

The process continues at block 118, where the controller 78 sends a control signal 119 to the actuator 66, which then activates to move the launch tube 16 about the pivot point 64 thereby changing the angle of inclination θ. At block 120, the position sensor 82 determines the current angle of inclination θ and provides a position signal 107 to the controller 78. Once the sensed or current angle θ equals the desired angle θ calculated by the controller 78 (block 122), then the projectile 25 may be discharged by the user depressing the trigger 24 at block 124. A visual or audible output may also be provided to the user to indicate that the desired angle of inclination θ has been achieved.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A projectile launching apparatus comprising:

a first projectile launcher assembly configured to discharge a first projectile;

a second projectile launcher assembly coupled to said first projectile launcher assembly and configured to discharge a second projectile;

a first and second aiming mechanism, wherein said first aiming mechanism is coupled to said first projectile launcher assembly adapted to determine a path of said first projectile, said second aiming mechanism is coupled to said second projectile launcher assembly and comprises a plurality of sections comprising:

an actuator operably coupled to said first projectile launcher assembly and said second projectile launcher assembly, said actuator configured to adjust an angle of inclination of at least a portion of said second projectile launcher assembly relative to said first projectile launcher assembly;

a positioning section adapted to determine at least one position data comprising a first position data, wherein said positioning section comprises a range finder configured to generate said first position data comprising a range signal indicative of a distance to a target from said range finder;

a controller comprising a memory, an input and output portion, and a digital logic portion adapted to process machine readable instructions which are stored in said memory, wherein said machine readable instructions comprises a plurality of processing sequences comprising a first processing sequence;

an inclination sensor operably coupled to the controller and configured to generate a second position data comprising a position signal indicative of the angle of inclination of the second projectile launcher assembly coupled to the first projectile launcher assembly; and an override operably coupled to the controller, the controller configured to prevent operation of the second projectile launcher assembly if the range signal indicates a distance beyond the maximum range of the projectile, absent activation of the override;

wherein said controller is operably coupled to the range finder and inclination sensor, said controller is adapted to selectively adjust said angle of inclination in a plurality of arc trajectories based on said range signal.

2. The apparatus of claim 1, wherein the range finder is a laser range finder.

3. The apparatus of claim 1, further comprising a projectile selector operably coupled to the controller, the selector configured to be manipulated by a user for selecting between a plurality of different types of projectiles for discharge by said second projectile launcher and having different representative trajectory profiles, the angle of inclination being varied by the controller based upon the selected type of projectile, wherein said controller further selectively adjusts said actuator and said angle of inclination based on a setting of said projectile selector, said first position data comprising said range signal, and said second position data produced by said inclination sensor.

4. The apparatus of claim 1, wherein the first projectile has a first arc trajectory profile, and the second projectile has a second arc trajectory profile, wherein said first arc trajectory is higher than said second arc trajectory as measured from a first and second reference associated with a path of said first and second projectiles.

5. The apparatus of claim 4, wherein the high arc trajectory projectile comprises at least one of a high explosive grenade, a non-lethal round, an illuminating grenade, a smoke grenade, a CS gas grenade, and a high explosive dual purpose grenade.

6. The apparatus of claim 1, further comprising a power supply operably coupled to the actuator.

7. The apparatus of claim 1, wherein said positioning section further comprises a global positioning system adapted to produce a third position data comprising a point of origin location data for identifying a location of a portion of said second projectile launcher, wherein said controller is further adapted to selectively adjust said actuator and said angle of inclination based on said first position data comprising said range signal, said second position data comprising said position signal, and said third position data.

* * * * *